US012521777B2

(12) United States Patent
Mengel et al.

(10) Patent No.: US 12,521,777 B2
(45) Date of Patent: Jan. 13, 2026

(54) METHOD AND DEVICE FOR GUIDING AND CENTERING A METAL ROLLING STOCK IN A ROLLING MILL

(71) Applicant: SMS group GmbH, Düsseldorf (DE)

(72) Inventors: Christian Mengel, Siegen (DE); Olaf Norman Jepsen, Siegen (DE); Bernhard Ehls, Hilchenbach (DE); Wolfgang Fuchs, Hilchenbach (DE)

(73) Assignee: SMS group GmbH, Düsseldorf (DE)

( * ) Notice: Subject to any disclaimer, the term of this patent is extended or adjusted under 35 U.S.C. 154(b) by 317 days.

(21) Appl. No.: 18/282,127

(22) PCT Filed: Jan. 17, 2022

(86) PCT No.: PCT/EP2022/050853

§ 371 (c)(1),
(2) Date: Sep. 14, 2023

(87) PCT Pub. No.: WO2022/207151

PCT Pub. Date: Oct. 6, 2022

(65) Prior Publication Data

US 2024/0165684 A1 May 23, 2024

(30) Foreign Application Priority Data

Mar. 30, 2021 (DE) ..... 10 2021 203 170.6

(51) Int. Cl.
*B21B 39/16* (2006.01)
*B21B 37/00* (2006.01)

(52) U.S. Cl.
CPC ..... *B21B 37/005* (2013.01); *B21B 39/16* (2013.01)

(58) Field of Classification Search
CPC ..... B21B 39/14; B21B 39/16; B21B 39/165
See application file for complete search history.

(56) References Cited

U.S. PATENT DOCUMENTS

2012/0096914 A1* 4/2012 Seidel ..... B21B 39/14 72/203
2015/0328669 A1 11/2015 Schilling et al.

FOREIGN PATENT DOCUMENTS

| | | | |
|---|---|---|---|
| EP | 2445659 | A1 | 12/2010 |
| JP | S60145218 | A | 7/1985 |
| JP | S61222626 | A | 10/1986 |
| JP | S6393401 | A | 4/1988 |
| JP | H05293526 | A | 11/1993 |

(Continued)

*Primary Examiner* — Debra M Sullivan
(74) *Attorney, Agent, or Firm* — Smartpat PLC

(57) ABSTRACT

A method and a device for guiding and centering a metallic rolling stock in a rolling mill having at least one assembly that is arranged in a rolling line and at least one rolling mill stand for shaping the rolling stock are disclosed. The method includes the use of lateral guide means, which exert a lateral force onto the moving rolling stock at different locations of the rolling line, wherein the method further includes the process of centering the inflow of the rolling stock ahead of a first assembly and/or ahead of a first rolling mill stand of the rolling mill using first lateral guide means and the process of aligning rolling stock downstream transversely to the rolling line using second lateral guide means, wherein the process of centering the inflow includes a funnel-shaped, flat guiding of the rolling stock and a point-shaped guiding of the rolling stock.

13 Claims, 4 Drawing Sheets

(56) References Cited

FOREIGN PATENT DOCUMENTS

| | | | |
|---|---|---|---|
| JP | H09239426 | A | 9/1997 |
| JP | 2013128978 | A | 7/2013 |

* cited by examiner

METHOD AND DEVICE FOR GUIDING AND CENTERING A METAL ROLLING STOCK IN A ROLLING MILL

CROSS-REFERENCE TO RELATED APPLICATION

This application is a national stage application, filed under 35 U.S.C. § 371, of International Patent Application PCT/EP2022/050853, filed on Jan. 17, 2022, which claims the benefit of German Patent Application DE 10 2021 203 170.6, filed on Mar. 30, 2021.

BACKGROUND

A method for guiding and centering a metal rolling stock in a rolling mill is generally known, for example, from EP 2 445 659 B1. The method described in EP 2 445 659 B1 comprises finish rolling a slab into a strip in a device comprising at least one furnace, at least one processing device downstream of the furnace in the direction of conveyance of the slab and a rolling mill downstream of the at least one processing device in the direction of conveyance of the slab, wherein means are provided for exerting a force onto the sides of the slab in order to move the axis of the slab in accordance with a predetermined position transversely to the direction of conveyance of the slab, in particular in accordance with the axis of the rolling mill. The method comprises first means for exerting a lateral force onto the slab acting on the slab at a first location, along with second means for exerting a lateral force onto the slab acting on the slab at a second location, wherein the second location is spaced from the first location in the direction of conveyance of the slab, wherein the first location is behind the furnace and the second location is ahead of, within, or behind the at least one processing device.

In the exemplary embodiment specifically described in EP 2 445 659 B1, the second location is ahead of a processing device in the form of a descaling device. Directly ahead of a first rolling mill stand of the rolling mill, mechanical lateral guides for the rolling stock are provided in the form of lateral guide rulers. Such a ruler guide at the inflow of the first shaping device or the first rolling mill stand, as the case may be, must be designed in such a manner that the rolling stock is not touched, since, otherwise, there is a risk of damage to the edges of the rolling stock. Therefore, such a ruler guide of the rolling stock is usually run at a spacing from the rolling stock. The lateral guide means according to EP 2 445 659 B1 ensure the centering of the slab ahead of the rolling mill, but an alignment of the slab transversely to the rolling line is not possible with such device A device and method for laterally guiding a rolled or cast product on a transport line is known, for example, from WO 2014/102189 A1. The device comprises a first and a second guide ruler, wherein the guide rulers are arranged opposite one another on both sides of the transport line and are connected to at least one actuator in each case for movement in the direction of a width of the transport line, wherein the actuators can be actuated perpendicularly to the direction of transport of the rolled or cast product. The guide rulers can each be positioned independently of one another with their associated longitudinal axis of the rolled or cast product at a predetermined angle and/or at a different spacing from the center of the transport line by actuation of the respective associated actuator, wherein in each case they have contract rollers that can be moved by a movement of the guide ruler into contact with a lateral edge of the rolled or cast product, in order to guide and/or compress the latter. Such design is complex. Precise setting of the forces acting laterally on the rolling stock is difficult with this concept. In addition, WO 2014/102189 does not contain any proposals as to how the rolling stock can be kept in the middle of the rolling mill or in the rolling line, as the case may be, until the end of the shaping operation.

Further prior art is known from JP H05293526 A.

SUMMARY

The disclosure relates to a method for guiding and centering a metal rolling stock in a rolling mill comprising assemblies and rolling mill stands arranged in a rolling line for shaping the rolling stock, wherein the method comprises the use of lateral guide means, which exert a lateral force onto the moving rolling stock at different locations of the rolling line, wherein the method further comprises the process of centering the inflow of the rolling stock ahead of a first assembly and/or ahead of a first rolling mill stand of the rolling mill using first lateral guide means and the process of aligning rolling stock downstream in the direction of transport of the rolling stock parallel to the rolling line using second lateral guide means.

The disclosure further relates to a device for carrying out the method.

The disclosure is based on the object of providing a method and a device of the type mentioned above, which make it possible to center the rolling stock in a rolling mill or in a transport line, as the case may be, of a rolling mill and to align it transversely to the direction of transport, wherein at the same time wear and/or damage to guides and to the rolling stock are avoided. In particular, the method and device should also enable the rolling stock to be held in the middle of the rolling mill or in the rolling line, as the case may be, until the end of the rolling operation.

According to one aspect, a method is proposed for guiding and centering a metal rolling stock in a rolling mill or in a transport line, as the case may be, of a rolling mill comprising assemblies and rolling mill stands arranged in a rolling line for shaping the rolling stock, wherein the method comprises the use of lateral guide means, which exert a lateral force onto the moving rolling stock at different locations of the rolling line, wherein the method further comprises the process of centering the inflow of the rolling stock ahead of a first assembly and/or ahead of a first rolling stand of the rolling mill using first lateral guide means and the process of aligning the rolling stock downstream thereof transversely to the rolling line using second lateral guide means. The method is characterized in particular by the fact that the process of centering the inflow comprises a funnel-shaped, flat guiding of the rolling stock and a point-shaped guiding of the rolling stock.

Assemblies within the context of the present disclosure are shears, scale washers, edgers, coil boxes and the like. Within the context of the disclosure, the term "assemblies" is used to distinguish them from the mill stands of the rolling mill, which serve to shape the rolling stock. The rolling stock may be slabs, thin slabs or a pre-strip. The rolling mill may be designed as a hot strip mill.

The method comprises, initially, catching the rolling stock as it flows into the rolling mill by the process of centering the inflow, i.e. at least ahead of a first assembly, preferably setting a funnel with a moderate slope using first lateral guide means with a relatively small skew angle of, for example, 1° to 30° preferably from 5° to 20° for a reliable strip transport as it flows in, and the process of centrally aligning the rolling stock for a next method step, for example for a shear cut. The method then provides for a central feeding of the rolling stock head and an alignment of the rolling stock transversely to the rolling line for the start of the subsequent shaping process. A relatively narrow guiding of the rolling stock using second lateral guide means enables the rolling stock to be held in the center during shaping, such that the shaping process takes place in the expected center position of the rolling mill stand of the rolling mill.

The rolling mill may, for example, be a finishing mill that is downstream of a roughing mill. However, the rolling mill may also be a roughing mill comprising one or more roughing stands.

The multi-stage method in accordance with the disclosure has the advantage that engagement with the edges of the rolling stock is gentle and low-wear, which is ensured in particular by the point-shaped guiding and centering of the rolling stock.

The combination of flat and point-shaped guiding by the process of centering the inflow has the advantage that an oblique or off-center inflow or outflow of the rolling stock head or foot of the rolling stock up to the end of the process of centering the inflow is gently deflected and at the same time securely guided by the structure of a funnel with a moderate slope, and the load on the point-shaped guiding is lower, which not only ensures secure guiding, but at the same time limits the load on the components.

With a preferred variant of the method, it is provided that third lateral guide means are further used for the process of centering the inflow of the rolling stock. Assemblies such as heating and separating devices may be arranged between the first and third lateral guide means. A two-stage process of centering the inflow has the advantage that the forces exerted on the rolling stock edge may be applied particularly gently and [ill.]. Alternatively, the first and third lateral guide means may be arranged directly one behind the other in the downstream direction of rolling with a first relatively small spacing, whereas the first and second and/or third lateral guide means are arranged in the downstream direction of rolling with a relatively large spacing from one another, such that a relatively large displacement moment may be introduced into the rolling stock or hot strip, as the case may be, with a relatively small application of force in order to align it transversely to the direction of conveyance as it flows into the rolling mill.

Preferably, the first and second lateral guide means are arranged one behind the other with a large spacing of between 6 and 20 m in the direction of rolling, while the first and third lateral guide means are arranged directly one behind the other with a second smaller spacing of, for example, 1 m to 6 m.

In particular, the first and third lateral guide means may be of different robustness or designed to absorb different amounts of force, as the case may be. For example, it may be provided that the first lateral guide means are designed to absorb greater forces than the third lateral guide means.

With a preferred variant of the method, it is provided that all lateral guide means are brought into and out of engagement with the rolling stock with a controllable variable adjusting force. For this purpose, the lateral guide means may be adjustable, for example, via hydraulic cylinders with position sensors and pressure sensors. For this purpose, it is advantageous if the method comprises a force and/or position control system of the lateral guide means. In addition, open-loop or closed-loop control of the lateral guide means may be provided as a function of the position of the rolling stock in the rolling mill.

The method expediently provides for further funnel-shaped, flat and point-shaped guiding of the rolling stock by means of the third lateral guide means.

With a further expedient and advantageous variant of the method, it is provided that the alignment of the rolling stock with the second lateral guide means takes place directly ahead of the first rolling mill stand of the rolling mill. "Directly" within the context of the present application means without the interposition of further assemblies or rolling mill stands.

Preferably, the lateral guide means are actively adjusted against the rolling stock, preferably with a contact force that is smaller than the plastic deformability of the rolling stock. This contact force may be between 5 and 50 KN, for example, if the rolling stock does not press against the lateral guide means due to its own movement dynamics. Furthermore, the lateral guide means are preferably adjusted against the rolling stock in such a manner that both sides of the lateral guide means are in contact with the rolling stock. In any event, the contact force applied by the lateral guide means is dimensioned in such a manner that no compression of the rolling stock is caused at the edges.

An edger is not a lateral guide means within the context of the disclosure.

Preferably, the guide of the rolling stock for aligning the rolling stock transversely to the rolling line comprises a guide that is narrower than the process of centering the inflow guide, in order to ensure the holding of the rolling stock in the rolling line.

Furthermore, it is advantageous if the first lateral guide means are temporarily disengaged from the rolling stock after a first contact with the rolling stock and prior to a second contact with the rolling stock by means of the second or third lateral guide means or at least one further lateral guide means. This has the advantage that the strip head pushed into the center of the rolling mill by the first lateral guide means is also transported in the center of the rolling mill until the next contact with a further lateral guide means.

According to a further advantageous variant of the method, it may be provided that the alignment and position of the rolling stock with respect to the rolling line is detected by sensors and that an adjusting movement and/or adjusting force of the lateral guide means is controlled as a function of the position and/or alignment of the rolling stock. The alignment of the rolling stock with respect to the rolling line may be detected either by pressure transducers in adjusting cylinders of the lateral guide means or by means of separate sensors.

The position of the rolling stock with respect to the rolling line is detected in an advantageous manner by a strip tracking system, wherein the instantaneous position of the rolling stock head and the rolling stock foot is detected.

The first, second and/or third lateral guide means may each be designed to absorb different forces and/or may be adjustable to the rolling stock edge with different forces, in order to positively influence the rolling stock edge in this manner, for example to achieve pre-consolidation of the rolling stock edge prior to a first processing step if necessary or also to prevent edge consolidation.

The task underlying the disclosure is further achieved by a device that is suitable and intended in particular for carrying out the method of the type described above.

According to one aspect, a device for guiding and centering a metal rolling stock in a rolling mill is provided, wherein the rolling mill comprises assemblies arranged in a rolling line and rolling mill stands for shaping the rolling stock, at least comprising first and second lateral guide means arranged at different spaced-apart locations of the rolling line, wherein at least first lateral guide means form an inflow centering of the rolling stock and are arranged at a first large spacing ahead of a first rolling mill stand and at least second lateral guide means are arranged at a second smaller spacing ahead of the first rolling mill stand and are provided for aligning the rolling stock parallel and centrally to the rolling line.

The device is characterized in particular by the fact that at least the first lateral guide means have a flat guide for the rolling stock and additionally a point-shaped guide for the rolling stock, wherein the point-shaped guide is preferably designed as a roller lateral guide.

The first and second lateral guide means may be arranged with a relatively large spacing from one another, in order to be able to apply a large moment with the lowest possible contact force to the rolling stock when the rolling stock is aligned transversely to a center line of the rolling mill.

Preferably, at least third lateral guide means are further provided. The third lateral guide means may be arranged at a relatively short spacing behind the first lateral guide means. The second and/or third lateral guide means each comprise a flat guide and additionally at least one point-shaped guide for the rolling stock.

According to such variant, the concept of the method along with the device comprises the arrangement of at least two lateral guide means arranged directly one behind the other with adjustable rollers for a guide-rolling stock contact without damages to the edges, which are individually moved and flexibly adjusted. Such guides are formed in each case by a combination of flat guides and point-shaped guides, wherein the first and third lateral guide means form a kind of double funnel, by means of which the rolling stock is initially guided in a manner centered into the subsequent assemblies prior to a shaping step, and enters such assemblies in a centered state.

As mentioned above, the flat guides are substantially funnel guides.

With an advantageous variant of the device, it is provided that the roller lateral guide is arranged on the outflow side of the funnel guide and/or on the inflow side of the funnel guide. For example, the first and third lateral guide means may have the roller lateral guides or point-shaped guide, as the case may be, arranged on the outflow side of the funnel guide. The second lateral guide means may be provided in an advantageous manner with a roller lateral guide on the inflow side for closer guiding and aligning of the rolling stock transversely to the rolling line.

The lateral guide means are advantageously adjustable on both sides of the rolling stock with a predeterminable force, preferably in different angular positions. The alignments of the lateral guide means in different angular positions relative to the center of the rolling mill or to the rolling line, as the case may be, and thus relative to the lateral edges of the rolling stock is particularly advantageous for the funnel-shaped arrangement of the first and third lateral guide means.

Advantageous embodiments of the invention are explained below with reference to the accompanying drawings, for example.

DETAILED DESCRIPTION

Figure 1:
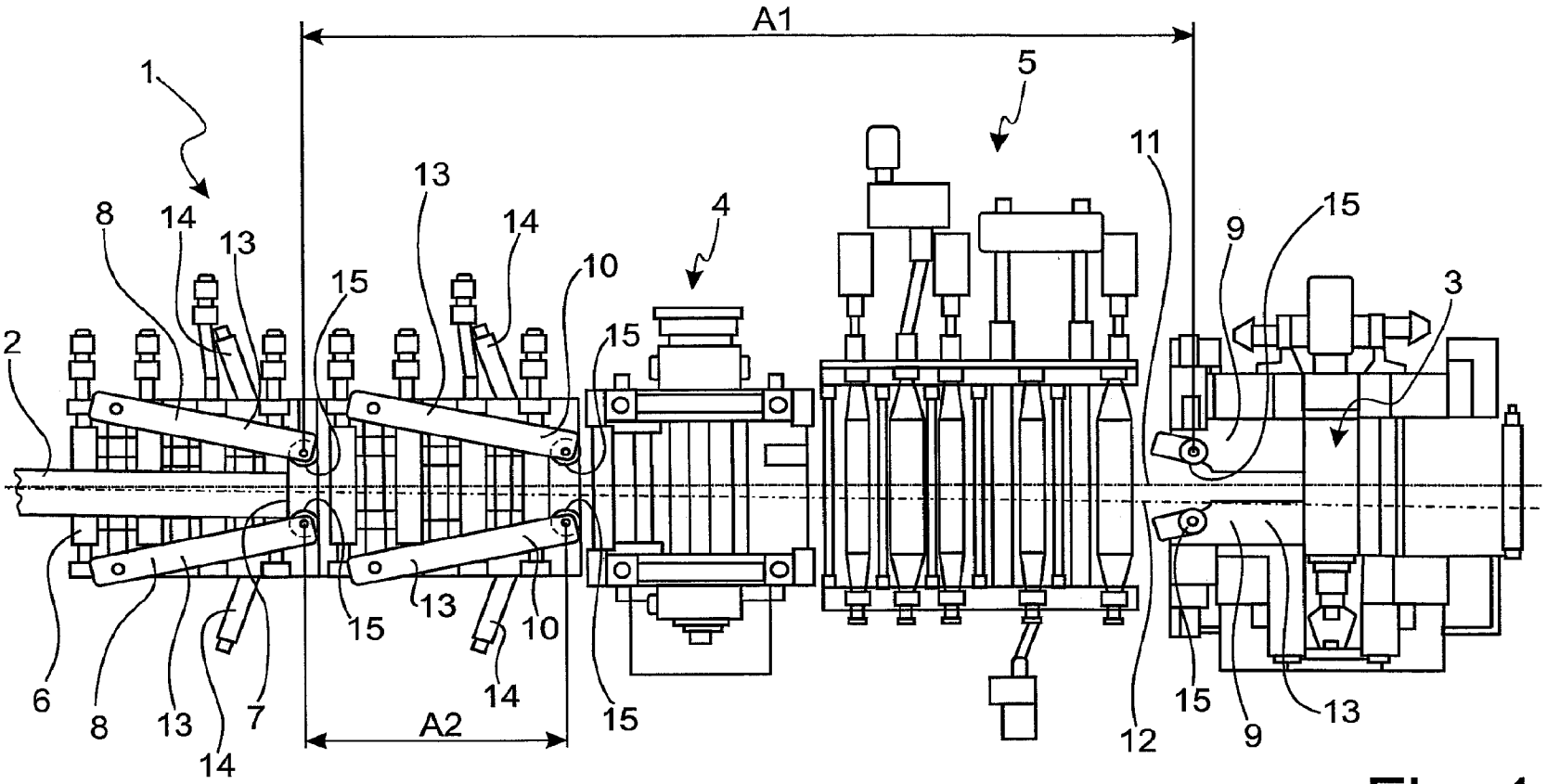
FIG. 1 is a schematic top view of a part of a rolling mill with devices for guiding and centering the rolling stock.
Figure 2:
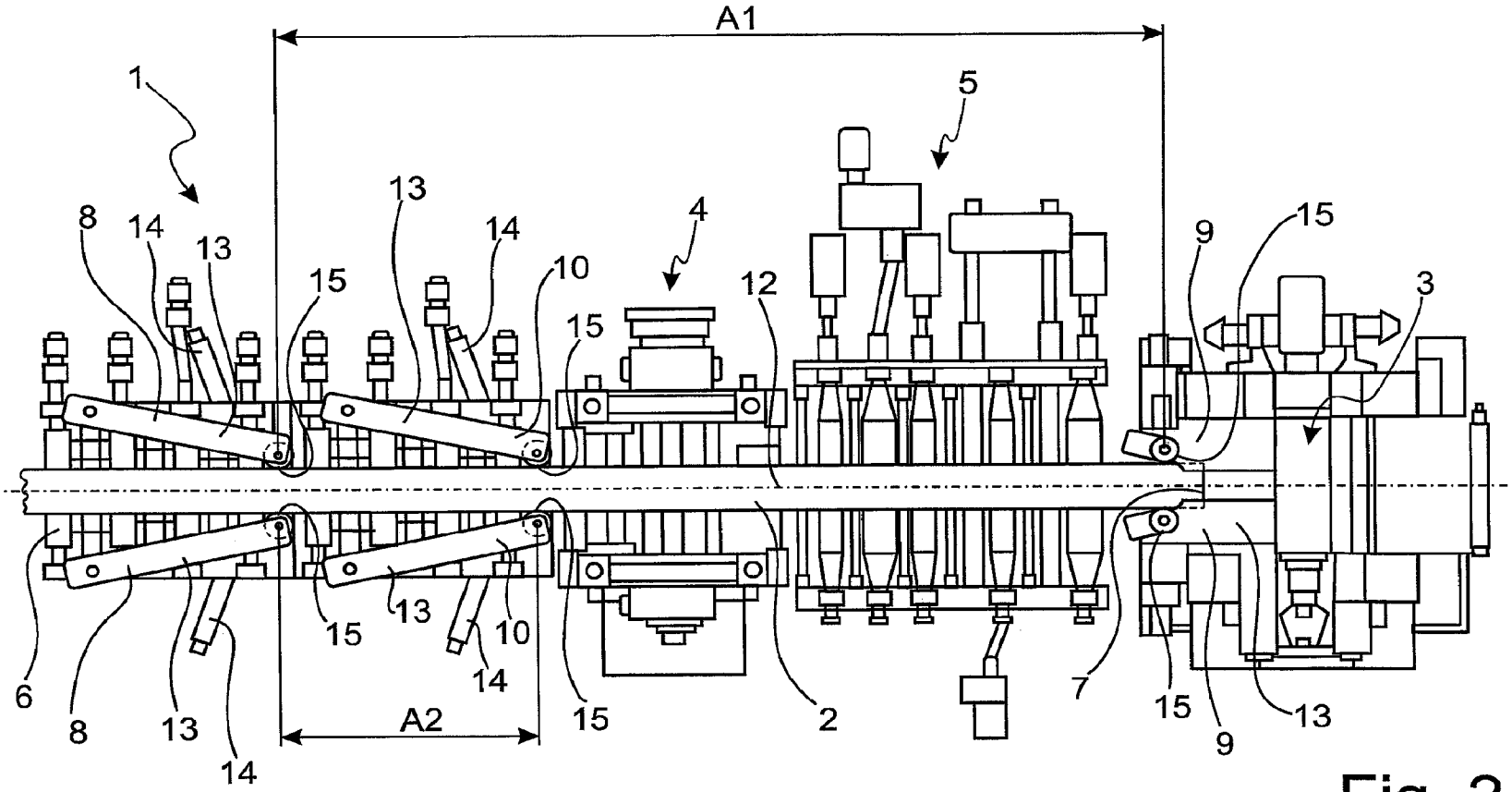
FIG. 2 is a view corresponding to FIG. 1, with which the rolling stock is in a different position.

In the following, reference is first made to the representations in FIGS. 1 and 2, which show a top view of the inflow region of a rolling mill 1, with which a strip-shaped rolling stock 2 is fed to a shaping operation from upstream processes such as a heating furnace, casting machine or roughing stand. The rolling mill 1 is a finishing mill, preferably comprising a plurality of rolling mill stands, of which a first rolling mill stand 3 is indicated. The rolling stock 2 is, for example, a hot strip that, for example, passes through a shear 4 and a scale washer 5 in the rolling mill 1, before being fed to the first rolling mill stand 3 in the rolling mill 1. The rolling stock 2 in the form of the hot strip is fed in a known manner via a roller table 6 to the first assembly of the rolling mill 1 in the form of the shear 4, which in the present case is designed as a drum shear. The rolling stock 2 passes through the rolling mill 1 from left to right in the representations, wherein FIG. 1 shows the rolling stock 2, while a rolling stock head 7 (strip head) is located on the roller table 6 in the region of first lateral guide means 8.

Directly downstream of the first lateral guide means 8 in the direction of transport of the rolling stock 2 are third lateral guide means 10, which are designed approximately in accordance with the first lateral guide means 8. At a spacing A1 from the first lateral guide means 1, second lateral guide means 9 are arranged directly ahead of the first rolling mill stand 3. In the illustrated exemplary embodiment, the first and third lateral guide means 8,10 are arranged directly behind one another with a second smaller spacing A2 of, for example, 1 m to 6 m, which is significantly smaller than the spacing A1 of, for example, 6 m to 20 m between the third lateral guide means 10 and the second lateral guide means 9. The first lateral guide means 8 are arranged at a large spacing ahead of the first rolling mill stand 3, whereas the second lateral guide means 9 are arranged directly ahead of the first rolling mill stand 3.

The first lateral guide means 8 and third lateral guide means 10 are designed in the form of a funnel with a moderate slope, which form a tapered funnel shape deviating from a parallel line by, for example, 1° to 30°. The angular position of the funnels can be set in a variable and deviating manner.

Between the third lateral guide means 10 and the second lateral guide means 9, initially the shears 4 and directly thereafter the scale washer 5 are arranged in the direction of transport of the rolling stock 2. Other configurations of the arrangement are conceivable. For example, the first and third lateral guide means 8,10 may be provided ahead of a coil box and a shear arranged behind it in the direction of transport. The spacing A1 from the second lateral guide means 9 to the third lateral guide means 10 is selected to be relatively large in order to be able to exert a maximum lever arm on the rolling stock 2 between such two spaced-apart contact points with the rolling stock 2, in order to be able to align and displace the latter transversely to the direction of transport on the roller table 6 from a target position to an ideal line or to the center line 11, as the case may be, of the rolling mill 1. The respective actual alignment of the rolling stock 2 is indicated in the figures by a roughly dashed line 12.

Figure 3:
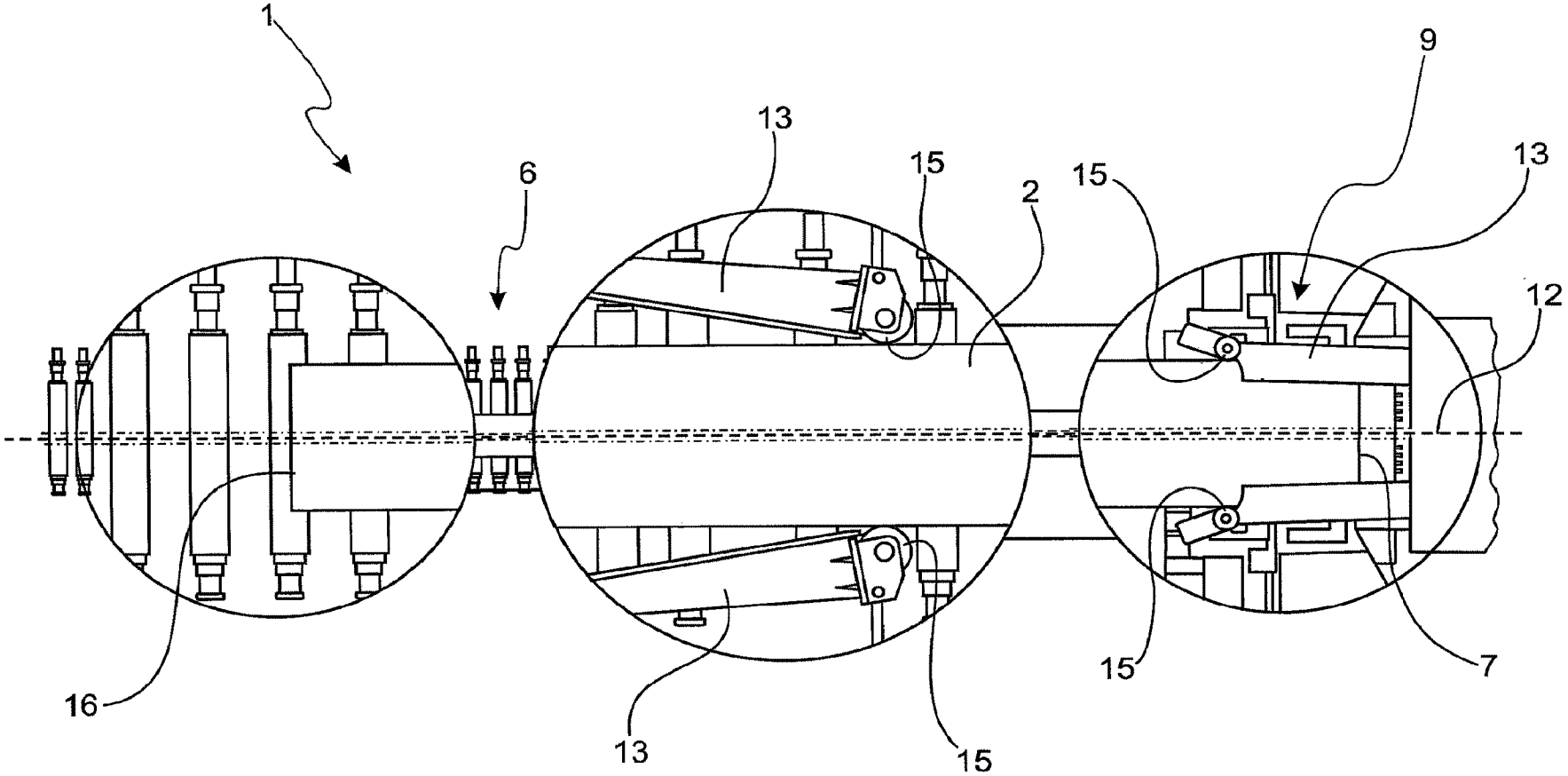
FIG. 3 is an enlarged representation of the guiding of the rolling stock at different positions and FIG. 4 is a schematic representation of various positions of the rolling stock in the rolling mill.

As can be seen in particular from FIG. 3, the first, second and third lateral guide means 8, 9, 10 each comprise two guide legs 13, each of which can be both pivoted and adjusted transversely to the center line 11 of the rolling mill by means of adjusting cylinders 14. The adjusting cylinders 14 are preferably designed as hydraulic cylinders which are supported against corresponding abutments. Each guide leg 13 forms a guide surface aligned in the direction of the lateral edges of the rolling stock 2, which in the case of the first and third lateral guide means 8, 10 is adjoined by a point-shaped support in the form of a guide roller 15. The guide legs 13 of the first and third lateral guide means 8, 10 are each aligned or adjusted, as the case may be, in the shape of a funnel, such that the first and third lateral guide means 8, 10 form double funnels, which effect a process of centering the inflow of the rolling stock 2.

As shown in FIG. 1, the rolling stock 2 arranged off-center on the roller table 6 initially comes into contact with a guide leg 13 of the first lateral guide means 8. In such a case, the first lateral guide means 8 initially fulfill the function of trapping the rolling stock 2, which may be in the form of a slab, thin slab or pre-strip, for example.

The method involves setting a funnel with a moderate slope with a low skew angle, such that the rolling stock 2 initially comes into contact with the first lateral guide means 8 as gently as possible. A further centering is then performed by means of the third lateral guide means 10. The guide rollers 15 of the first and third lateral guide means 8, 10 accordingly rest only at points on the edges of the rolling stock 2. Therefore, the rolling stock 2 is roughly centered and fed to the shear 4 and subsequent scale washer 5.

The rolling stock head 7 then enters the guide region of the third lateral guide means 10, which are designed to correspond to the first lateral guide means 8.

The second lateral guide means 9 are arranged directly ahead of the first rolling mill stand 3 of the rolling mill 1. The second lateral guide means 9 also comprise two guide legs 13, on which, however, in contrast to the first and third lateral guide means 8, 10, guide rollers 15 are arranged upstream, i.e. on the inflow side of the guide formed by the guide legs 13, as viewed in the direction of transport of the rolling stock 2. Upstream of the guide rollers of the second lateral guide means 9, there is a funnel that may be moved together with the guide rollers 15 and that ensures that the rolling stock head 7 flows in between the guide rollers of the second lateral guide means 9. The width of the opening between the guide legs 13 of the second lateral guide means 9 is smaller than that of the funnel openings of the first and third lateral guide means 8,10. In the ideal case, the guide legs 13 of the second lateral guide means 9 are aligned parallel to one another. The guide rollers 15 cause the rolling stock 2 to be held in the center line 11 of the rolling mill 1 throughout the entire rolling process, even if the rolling stock foot 16 of the rolling stock 2 has already left the guide region of the first and third lateral guide means 8, 10, as shown in FIG. 4*d*. The guide legs 13 may still hold the rolling stock even if the rolling stock foot 16 of the rolling stock 2 has already left the guide rollers 15 of the second lateral guide means 9.

FIGS. 4*a*) to 4*c*) show a schematic sequence of a rolling stock flowing into the rolling mill 1, wherein FIG. 4*d*) depicts the state in which the rolling stock foot 16 of the rolling stock 2 is still located between the second lateral guide means 9 and a following section of the rolling stock is already located on the roller table 6 of the rolling mill 1.

With the method, the rolling stock head 7 initially enters the funnel opening of the first lateral guide means 8. If the rolling stock 2 is skewed, the rolling stock head 7 will initially come into contact with one of the guide legs 13 of the first lateral guide means 8 and catch the rolling stock 2. The rolling stock 2 then enters the inflow region of the third lateral guide means 10. By means of the third lateral guide means 10, a central alignment of the rolling stock 2 for the next method step is carried out, for example a shear cut by means of the shear 4 downstream of the third lateral guide means 10.

Figure 4:
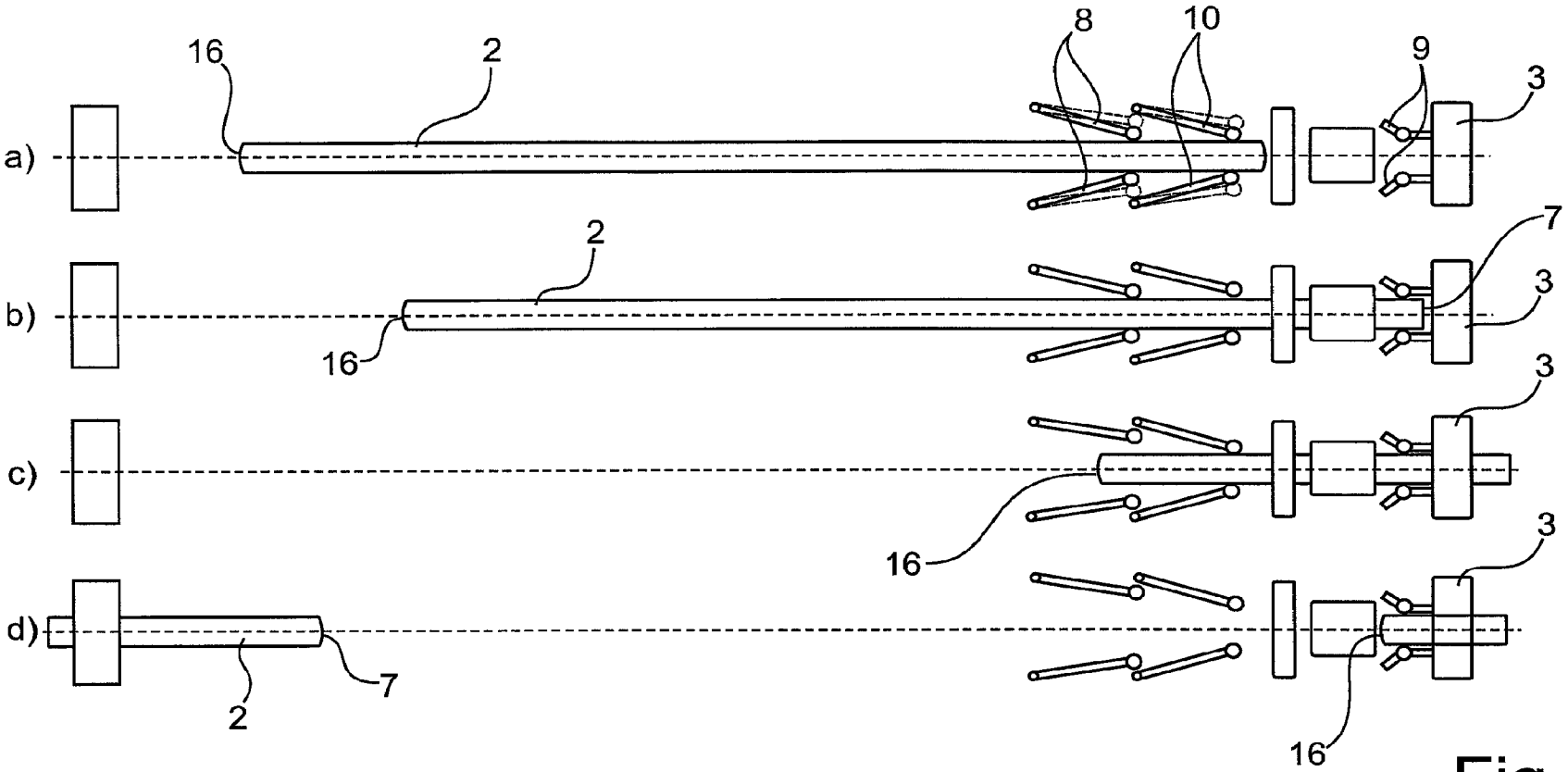

FIG. 4 *b*) shows the state of the rolling stock 2 in which the rolling stock head 7 has just entered the inflow region of the second lateral guide means 9. In such position of the rolling stock 2, a secure guiding and aligning of the rolling stock 2 is ensured by all lateral guide means 8, 9, 10, such that the rolling stock head 7 may be fed centrally to the shaping process by the first rolling mill stand 3 and may also be held in such position throughout the entire rolling process. FIG. 4 *d*) shows the state of the rolling stock 2 with which the rolling stock foot 16 is still just in the region of the guide with the second lateral guide means 9.

LIST OF REFERENCE SIGNS

1 Rolling mill
2 Rolling stock
3 Rolling mill stand
4 Shear
5 Scale washer
6 Roller table
7 Rolling stock head
8 First lateral guide means
9 Second lateral guide means
10 Third lateral guide means
11 Center line of the rolling mill
12 Actual line of the rolling stock
13 Guide leg
14 Adjusting cylinder
15 Guide roller
16 Rolling stock foot
A1 First large spacing between the first and second lateral guide means
A2 Second small spacing between the first and third lateral guide means

The invention claimed is:

1. A method for guiding and centering a metal rolling stock (2) in a rolling mill (1), the rolling mill (1) comprising an assembly that is arranged in a rolling line and a first rolling mill stand (3) for shaping the rolling stock (2), the method comprising:

exerting a lateral force onto the rolling stock (2) at different locations of the rolling line by lateral guide means (8,9,10) while the rolling stock (2) is moving;

centering an inflow of the rolling stock (2) ahead of the assembly and/or ahead of the first rolling mill stand (3) of the rolling mill (1) using a first of the lateral guide means (8);

aligning the rolling stock (2) transversely to the rolling line using a second of the lateral guide means (9) downstream of the first of the lateral guide means (8);

wherein centering the inflow comprises a funnel-shaped, flat guiding of the rolling stock (2) and a point-shaped guiding of the rolling stock (2), wherein centering the inflow of the rolling stock (2) further comprises using a third of the lateral guide means (10), wherein the lateral guide means (8,9,10) each include a flat guide for the rolling stock substantially formed as a funnel guide and a point-shaped guide for the rolling stock formed as a roller guide, and wherein the lateral guide means (8,9,10) are each actively adjusted against the rolling stock (2).

2. The method according to claim 1, wherein the first of the lateral guide means (8) and the third of the lateral guide means (10) are arranged directly one behind the other in the downstream direction of rolling with a first relatively small spacing (A2) and wherein the first of the lateral guide means (8) and the second of the lateral guide means (9) are arranged at a relatively larger spacing (A1) from one another in the downstream direction of rolling.

3. The method according to claim 1, wherein the lateral guide means (8, 9, 10) are brought into and out of engagement with the rolling stock (2) with a controllable, variable adjusting force.

4. The method according to claim 1, wherein the alignment of the rolling stock (2) with the second of the lateral guide means (9) takes place directly ahead of the first rolling mill stand (3) of the rolling mill (1).

5. The method according to claim 1, wherein the lateral guide means (8, 9, 10) are adjusted against the rolling stock (2) with a contact force that is smaller than a plastic deformability of the rolling stock (2).

6. The method according to claim 1, wherein the second of the of the lateral guide means (9) is narrower than the first of the lateral guide means (8).

7. The method according to claim 1, further comprising:

temporarily disengaging the first of the lateral guide means (8) from the rolling stock (2) after a first contact with the rolling stock (2) and prior to a second contact with the rolling stock (2) by the second of the lateral guide means (9) or the third of the lateral guide means (10) or a further of the lateral guide means.

8. The method according to claim 1, further comprising:

detecting an alignment and a position of the rolling stock (2) with respect to the rolling line (11) by sensors, and controlling an adjusting movement and/or adjusting force of the lateral guide means (8, 9, 10) as a function of the position and/or the alignment of the rolling stock (2), or setting the position of the lateral guide means and with a selectable spacing from the rolling line.

9. A device for guiding and centering a metal rolling stock (2) in a rolling mill (1), wherein the rolling mill (1) comprises an assembly arranged in a rolling line (11) and a rolling mill stand (3) for shaping the rolling stock (2), the device comprising:

first lateral guide means (8), second lateral guide means (9), and third lateral guide means (10) arranged at different spaced-apart locations of the rolling line (11), wherein the first lateral guide means (8) form an inflow centering of the rolling stock (2), wherein the second lateral guide means (9) are arranged ahead of the rolling mill stand (3) and are provided for aligning the rolling stock parallel and centrally to the rolling line, wherein the first lateral guide means (8), the second lateral guide means (9), and the third lateral guide means (10) each have a flat guide for the rolling stock substantially designed as a funnel guide and a point-shaped guide for the rolling stock designed as a lateral roller guide, and wherein the first lateral guide means (8), the second lateral guide means (9), and the third lateral guide means (10) are each adjustable on both sides of the rolling stock (2) with a predeterminable force.

10. The device according to claim 9, wherein the first lateral guide means (8) and the second lateral guide means (9) are arranged at a first large spacing A1 from one another, and wherein the second lateral guide means are arranged directly ahead of the rolling mill stand (3).

11. The device according to claim 9, wherein the roller lateral guide is arranged on an outflow side of the funnel guide.

12. The device according to claim 9, wherein the roller lateral guide is arranged on an inflow side of the funnel guide.

13. The device according to claim 9, wherein the lateral guide means (8, 9, 10) are adjustable on both sides of the rolling stock (2) in different angular positions.

* * * * *